US006736031B1

(12) United States Patent
Kang

(10) Patent No.: US 6,736,031 B1
(45) Date of Patent: May 18, 2004

(54) PLIERS FOR DISASSEMBLING A PIPE FASTENING CLAMP

(76) Inventor: Hsin Fa Kang, No. 44, Alley 50, Lane 143, Kai-Nan Street, Tainan City (TW)

( * ) Notice: Subject to any disclaimer, the term of this patent is extended or adjusted under 35 U.S.C. 154(b) by 0 days.

(21) Appl. No.: 10/335,935

(22) Filed: Jan. 3, 2003

(51) Int. Cl.[7] ..... B25B 27/10

(52) U.S. Cl. ..... 81/9.3; 81/370; 81/322; 81/324; 81/328

(58) Field of Search ..... 81/9.3, 320, 322, 81/324, 328; 29/229, 243.56, 237

(56) References Cited

U.S. PATENT DOCUMENTS 6,276,236 B1 * 8/2001 Wu ..... 81/9.3
6,634,258 B2 * 10/2003 Pool et al. ..... 81/9.3
2002/0178869 A1 * 12/2002 Pool et al. ..... 81/9.3
2004/0011161 A1 * 1/2004 Gmeilbauer ..... 81/9.3

* cited by examiner

*Primary Examiner*—M. Rachuba

(57) ABSTRACT

A pair of pliers for disassembling a pipe-fastening clamp has two control members respectively having through holes. A control device is connected with the two control members and has two control tubular lines each inserted with a steel wire having one end inserted through the through hole of each control member. Each tubular line has one end provided with a positioning block and the other end fixed with a push member and the other end combined with two clamping blocks facing each other. The steel wire has one end fitted with a fixing member. Thus, the two clamping blocks are controlled to expand open the pipe fastening clamp for facilitating disassembling pipes.

2 Claims, 6 Drawing Sheets

PLIERS FOR DISASSEMBLING A PIPE FASTENING CLAMP

BACKGROUND OF THE INVENTION

1. Field of the Invention

This invention relates to a pair of pliers for disassembling a pipe fastening clamp, particularly to one provided at the upper end with two control members respectively having through holes, a control device connected with the control members and having two control tubular lines respectively inserted therein with a steel wire with one end inserted through the through holes of the control members of the pliers. Each control line has one end fixed with a positioning block and the other end provided with a push member. Each steel wire has on end fitted around with a fixing member compressed and secured thereon. The control line has the other end combined with two clamping blocks facing each other and respectively having a recessed groove at the inner side, with two springs respectively fitted around the steel wires located between the two clamping members. Thus, the control device has its two clamping members clamping and expanding open a pipe-fastening clamp to let it no longer clamp the pipe adapter of pipes for facilitating disassembling pipes.

2. Description of the Prior Art

As commonly known, there are many pipes (oil pipes, cooling water pipes, air pipes and the like) arranged in a crisscross pattern in the engine room of a car, and each adapter between two pipes are fixedly clamped by a resilient and powerful pipe fastening clamp 1, as shown in FIG. 1. The pipe fastening clamp 1 has its two clamp ears 10 protruding and intersecting outward. Under the circumstances, to repair or replace a pipe with a new one, the two clamp ears 10 of the pipe fastening clamp 1 have to be clamped inward first by a pair of needle nose or common pliers so as to expand open the pipe fastening clamp 1 for disassembling the pipe. However, there is only a little space in the engine room for a repairman's hands to carry out disassembling the pipes, therefore common tools are not applicable to do such work.

SUMMARY OF THE INVENTION

The objective of the invention is to offer a pair of pliers for disassembling a pipe fastening clamp, able to expand open a pipe fastening clamp and disassemble the pipes conveniently and quickly for repairing or replacing.

The pair of pliers for disassembling a pipe-fastening clamp is provided at the upper end with two control members respectively having through holes and has a control device connected with the control members. The control device has two control tubular lines respectively inserted therein with a steel wire which has one end inserted through the through holes of the control members of the pliers. Each control tubular line has one end fixed thereon with a positioning block which has one end provided with a projection having an annular groove for a lock washer to engage therein. Each control tubular line has the other end provided with a push member, and each steel wire is fitted around one end with a fixing member compressed and secured thereon. The control tubular lines have the other end further combined with two clamping blocks facing each other and respectively having a recessed groove at the inner side, with two springs respectively fitted around the steel wires positioned between the two clamping members.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
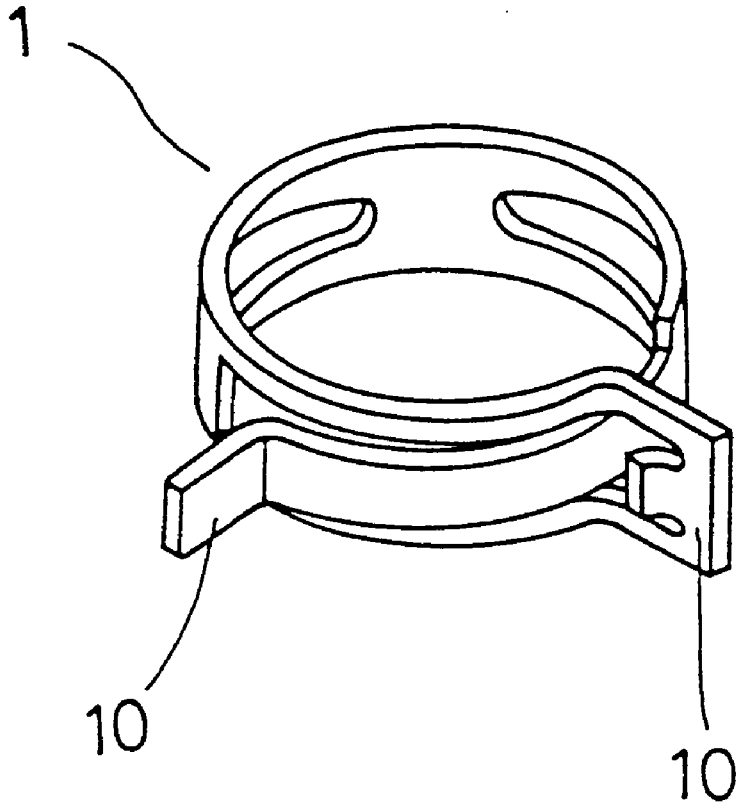
FIG. 1 is a perspective view of a pipe-fastening clamp.
Figure 2:
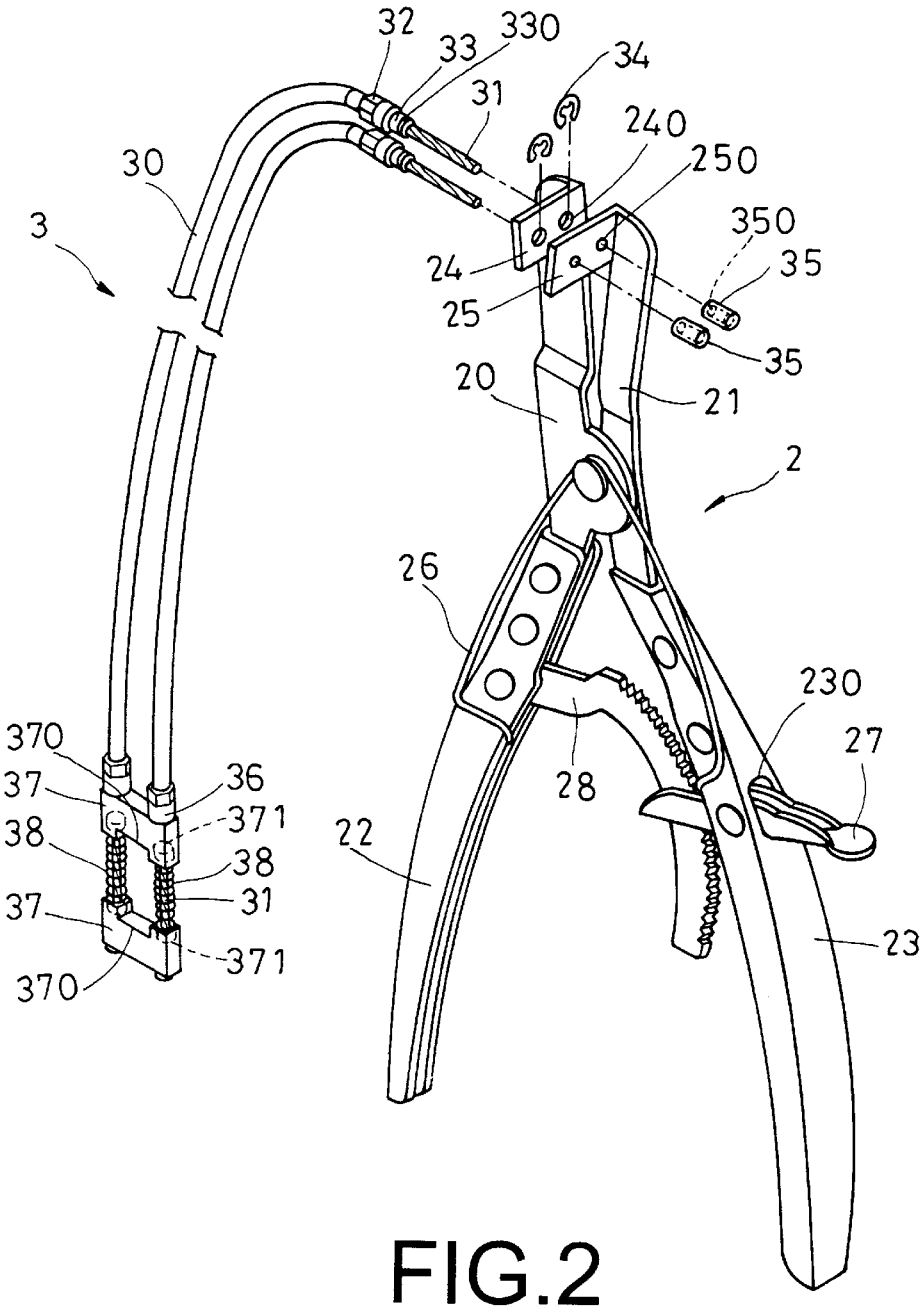
FIG. 2 is an exploded respective view of a pair of pliers for disassembling a pipe-fastening clamp in the present invention.
Figure 3:
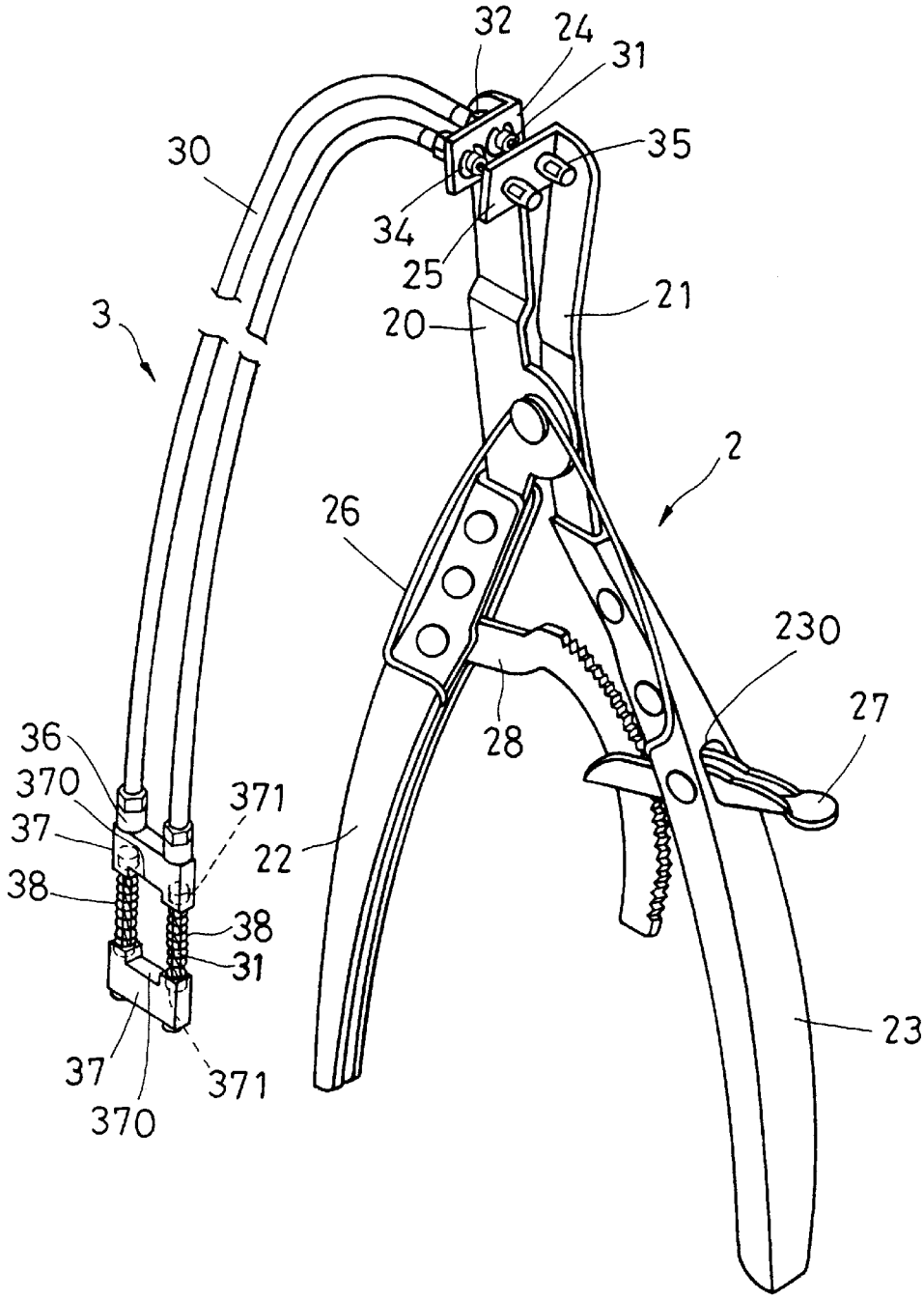
FIG. 3 is a perspective view of the pliers for disassembling pipe-fastening clamp in the present invention.

A preferred embodiment of a pair of pliers for disassembling a pipe-fastening clamp in the present invention, as shown in FIGS. 2 and 3, includes a pair of pliers 2 and a control device 3 combined together.

The pair of pliers 2 are composed of a left body 20 and a right body 21 pivotally combined together. The left and the right body 20 and 21 respectively have the lower portion formed with a handle 22, 23, with a through hole 230 bored at a proper position of the handle 23 of the right body 21. The left and the right body 20 and 21 are respectively provided at the upper end with a control member 24, 25 respectively having two through holes 240, 250 aligned to each other. A torsion spring 26 is pivotally combined with the left and the right body 20, 21 and has its two feet respectively pushing against the inner edge of the two handles 22, 23 to push outward the two handles 22, 23 permanently. A press lever 27 is pivotally combined in the through hole 230 of the handle 23 of the right body 21, and an adjusting and positioning member 28 has one end pivotally combined with the handle 22 of the left body 20 and the other end inserted through the press lever 27.

The control device 3 connected with the two control members 24, 25 of the pliers 2 is provided with two control tubular lines 30 respectively inserted therein with a steel wire 31, which has its opposite ends respectively extending out of the opposite ends of the control tubular line 30. Each control line 30 has one end fixed with a positioning block 32, which has one end provided with a projection 33 having an annular groove 330 for a lock washer 34 to be engaged therein. Each steel wire 31 has one end inserted through the through holes 240, 250 and fitted with a fixing member 35 having a lengthwise recessed hole 350 in the interior for the steel wire end to fit therein. Besides, each control line 30 has the other end fixed with a push member 36, and the two steel wires 31 protruding out of the foresaid other end of the control tubular lines 30 are fitted thereon with two clamping blocks 37 spaced apart and facing each other and respectively having a recessed groove 370 at the inner side, with two recessed holes 371 bored in the opposite sides of the recessed groove 370. Further, two springs 38 are respectively fitted around the two steel wires 31 located between the two clamping blocks 37 and have opposite ends respectively received in the recessed holes 371 of the two clamping blocks 37.

In assembling, as shown in FIGS. 2 and 3, firstly, the steel wires 31 respectively extending in and protruding out of the control tubular lines 30 are inserted through the through holes 240, 250 of the control members 24, 25 of the pliers 2, and the positioning block 32 of the control tubular line 30 has its front end contacting on the outer wall of the control member 24 of the left body 20. Next, the projection 33 is inserted through the through hole 240 of the control member 24 and has its annular groove 330 clasped therein with the lock washer 34 to secure the right ends of the two control tubular lines 30 on the left body 20. Lastly, the steel wires 31 protruding out of the right ends of the control tubular lines 30 are respectively inserted through the through holes 250 of the control member 25 of the right body 21 and have ends respectively fitted around with a fixing member 35, which is compressed and secured thereon, thus finishing combining the control device 3 with the pliers 2.

Figure 4:
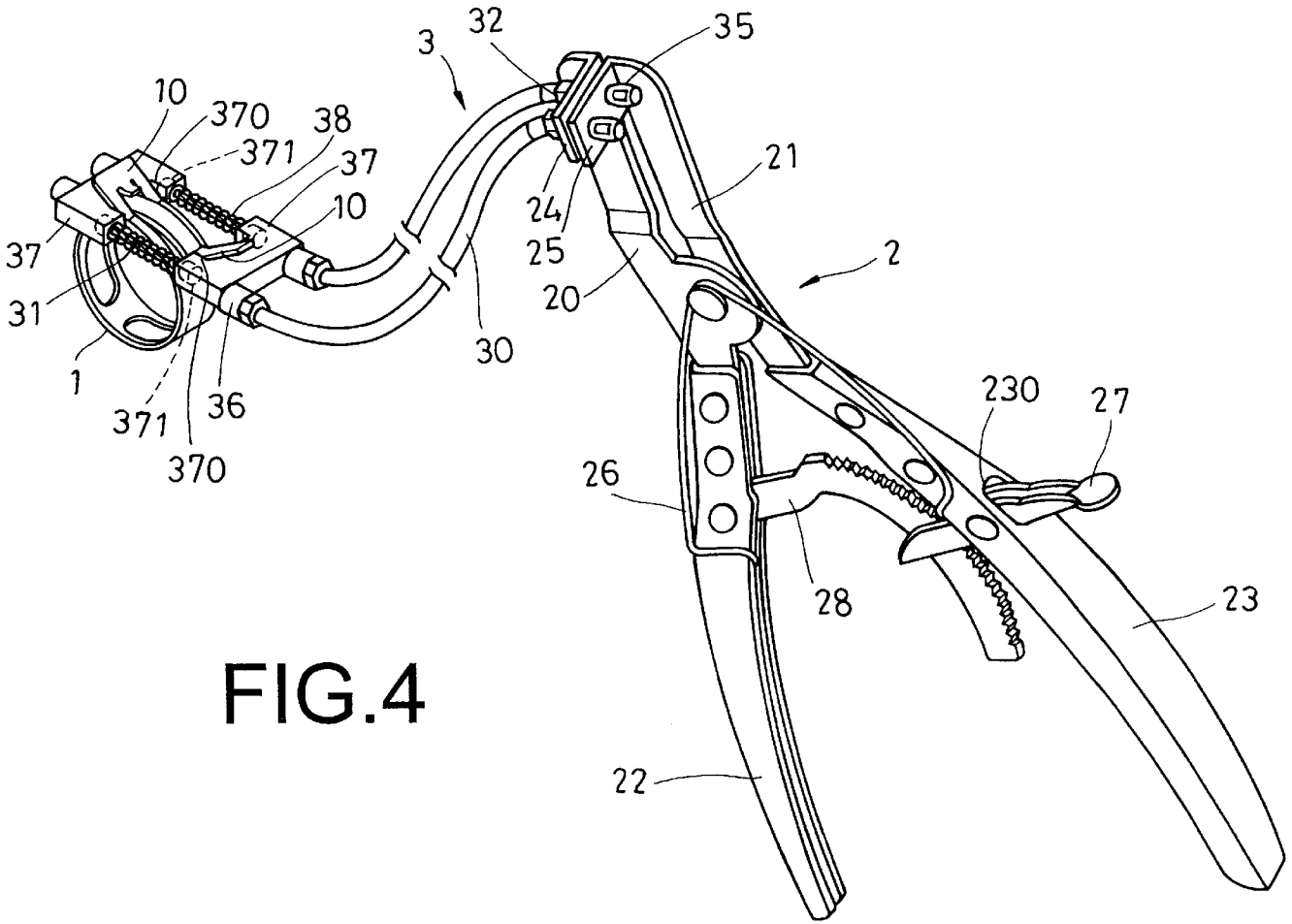
FIG. 4 is a perspective view of the pliers for disassembling a pipe fastening clamp in the present invention, illustrating the pliers not yet expanding open the pipe fastening clamp.
Figure 5:
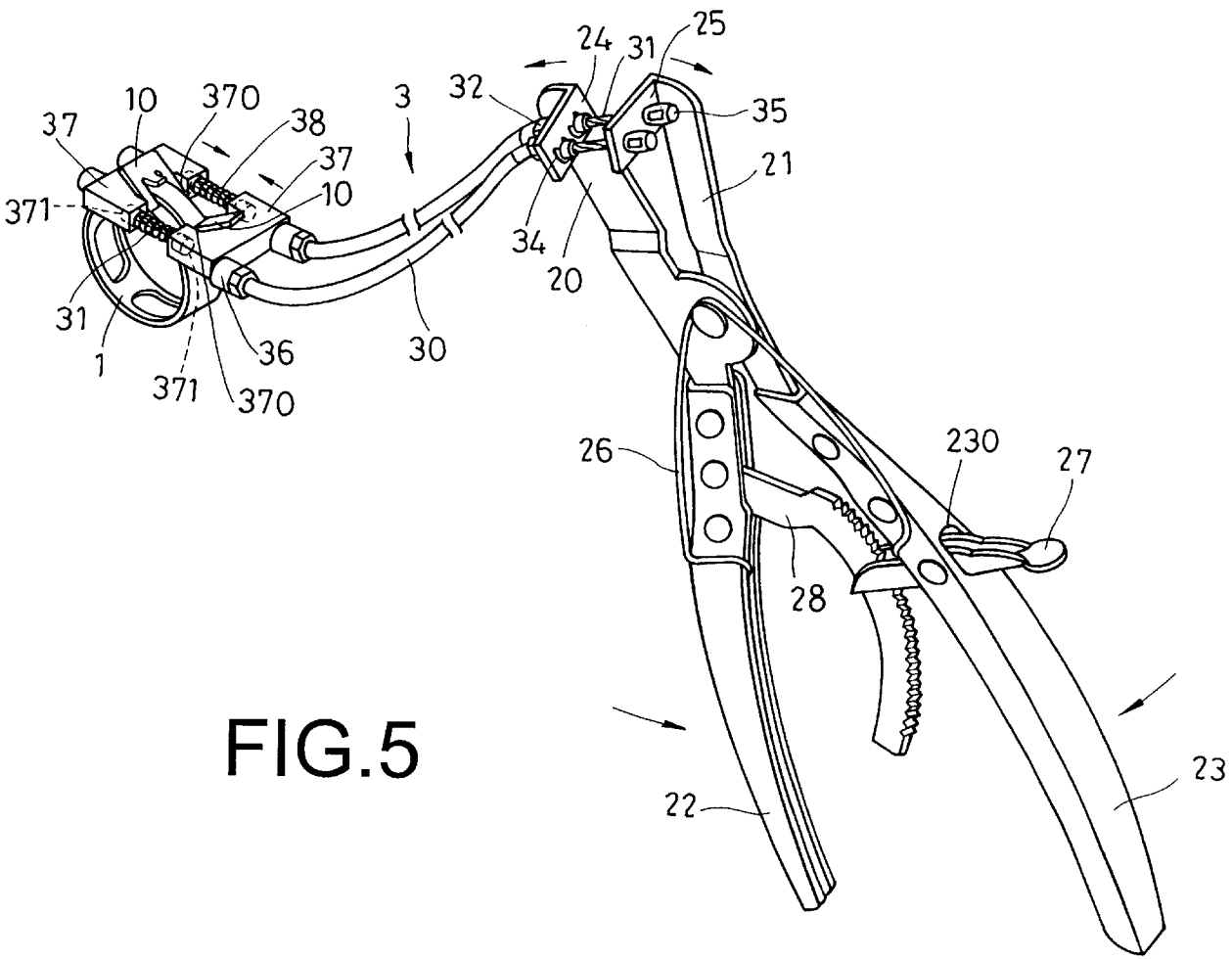
FIG. 5 is a perspective view of the pliers for disassembling a pipe fastening clamp in the present invention, illustrating the pliers expanding open the pipe fastening clamp; and, FIG. 6 is a partial exploded perspective view of a second preferred embodiment of the fixing member of the pliers for disassembling a pipe-fastening clamp in the present invention.

To expand open and disassemble a pipe fastening clamp 1, as shown in FIGS. 4 and 5, firstly, the two clamping blocks 37 of the control device 3 are respectively fitted around the opposite sides of clamp ears 10 of the pipe fastening clamp 1, letting the inner recessed grooves 370 of the two clamping member 37 respectively contact the outer side of the two clamp ears 10. Next, hold and squeeze inward the two handles 22, 23 with a single hand to force the two control members 24, 25 respectively to move outward and pull forward the steel wires 31, which simultaneously have the outer ends actuating the two clamping blocks 37 to move close to each other and compress the two springs 38 between the two clamping blocks 37. Thus, the two clamp ears 10 of the pipe fastening clamp 1 are clamped and pressed inward by the two clamping blocks 37 to let the circumference of the pipe fastening clamp 1 enlarged not to tighten the pipe any longer so as to facilitate disassembling the pipe, and at this time the adjusting and positioning member 28, and the press lever 27 engage and stop each other to keep the pliers in position.

On the contrary, to release the pipe fastening clamp 1 from clamped by the pliers, the press lever 27 is pushed upward and disengaged from the adjusting and positioning member 28, and at the same time the handles 22, 23 of the left and the right body 20, 21 are respectively pushed outward by the resilience of the two feet of the torque spring 26, and the two clamping blocks 37 are also respectively pushed outward by the resilience of the two springs 38, letting the pliers recover its original condition.

Figure 6:
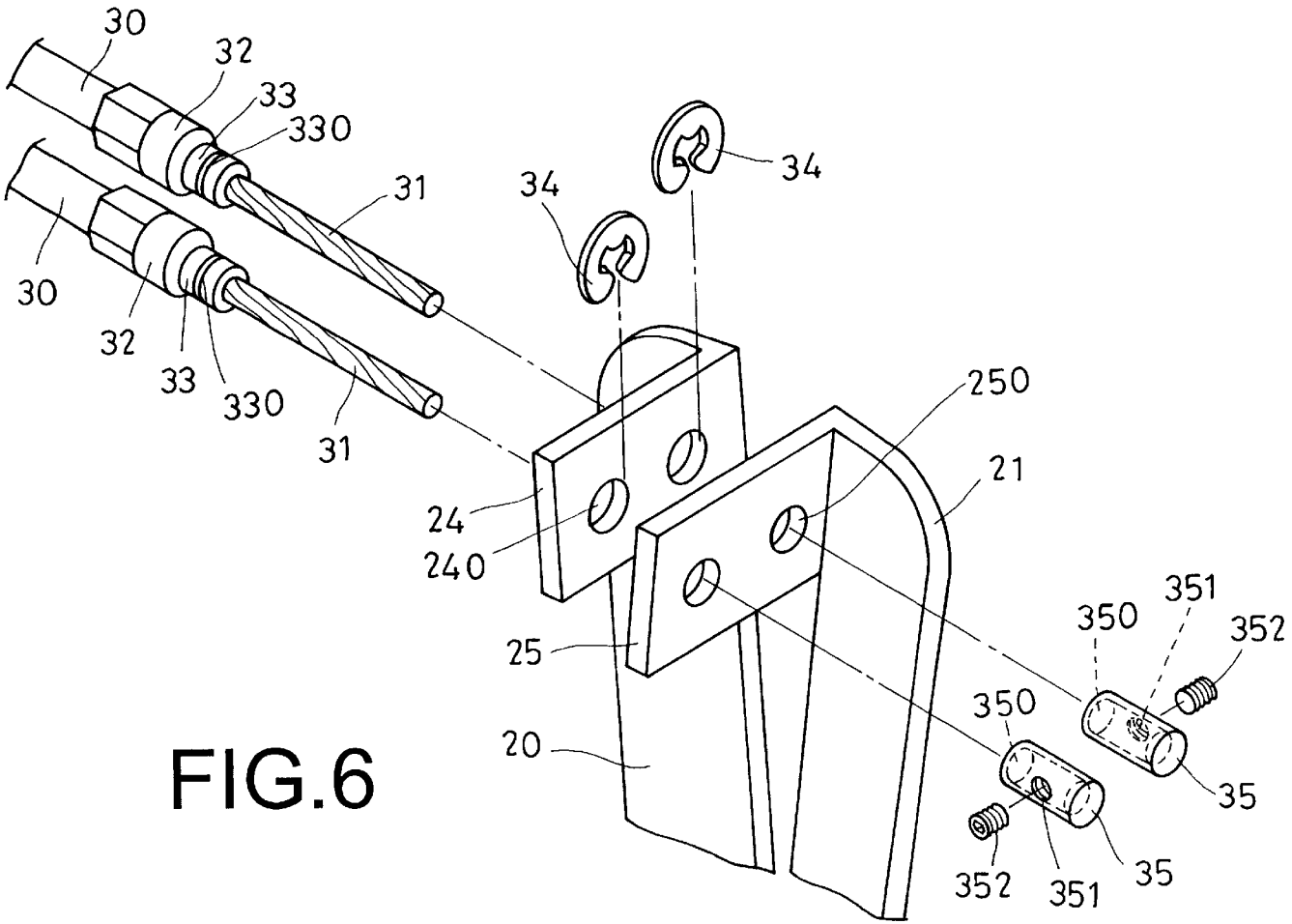

As described above, the two steel wires 31 have the ends respectively fitted around with the fixing member 35 having a lengthwise recessed hole 350 inside for the steel wires 31 to be inserted therein, and the fixing member 35 is compressed and secured on the steel wire end 31. A second preferred embodiment of the fixing member 35, as shown in FIG. 6, is to have its side wall bored with a threaded hole 351 communicating with the lengthwise recessed hole 350, with a bolt 352 screwed with the threaded hole 351 to secure the fixing member 35 on the end of the steel wire 31, which is then fixed with the control member 25 of the pliers 2.

While the preferred embodiments of the invention have been described above, it will be recognized and understood that various modifications may be made therein and the appended claims are intended to cover all such modifications that may fall within the spirit and scope of the invention.

What is claimed is:

1. A pair of pliers for disassembling a pipe fastening clamp comprising a left and a right body pivotally combined together, said left and said right body respectively having its lower portion formed with a handle, said right body having said handle bored with a through hole at a proper location, said left and said right body respectively having its upper end provided with a control member, a torque spring pivotally combined with said left and said right body, said torque spring having two feet respectively pushing against the inner edges of said two handles of said left and said right body, said torque spring able to always push said two handles outward, a press lever pivotally assembled in said through hole of said handle of said right body, an adjusting and positioning member having one end pivotally combined with said handle of said left body and the outer end inserted in said press lever; and, characterized by said control members respectively bored with through holes, a control device connected with said control members, said control device provided with two control tubular lines, said two control tubular lines respectively inserted therein with a steel wire, said steel wire having one end inserted through said through holes of said two control members, said control tubular line having one end provided with a positioning block, said positioning block having one end fixed with a projection, said projection formed with an annular groove for receiving a lock washer therein, said control tubular line having the other end provided with a push member, said steel wire having one end fitted around with a fixing member, said fixing member compressed and secured on the ends of said two steel wires, said control tubular lines having the other ends further combined with two clamping blocks facing each other, said two clamping blocks respectively bored at the inner side with a recessed groove, each said steel wire between said two clamp blocks fitted around with a spring, said handles of said pliers held and squeezed to force said two control members to pull forward said two steel wires, said two steel wires actuating said clamping blocks to move close to each other, said two clamping blocks clamping the two ears of a pipe fastening clamp, said pipe fastening clamp expanded open and no long clamping tightly the adapter of the pipe, convenient for disassembling the pipe.

2. The pair of pliers for disassembling a pipe fastening clamp as claimed in claim 1, wherein said fixing member fitted around one end of said steel wire is bored in its side wall with a vertical threaded hole communicating with its lengthwise recessed hole, and said vertical threaded hole is screwed therein with a fixing bolt.

* * * * *